US005345844A

United States Patent [19]

Marsaw

[11] Patent Number: 5,345,844

[45] Date of Patent: Sep. 13, 1994

[54] JAR LID OPENER APPARATUS

[76] Inventor: Morris R. Marsaw, 405 Annette St., P.O. Box 114, Espanola, Canada, P0P1C0

[21] Appl. No.: 44,804

[22] Filed: Apr. 12, 1993

[51] Int. Cl.[5] ..... B67B 7/18

[52] U.S. Cl. ..... 81/3.2; 81/3.32

[58] Field of Search ..... 81/3.2, 3.32, 3.4, 3.42, 81/3.07, 3.25, 3.31, 3.33

[56] References Cited

U.S. PATENT DOCUMENTS

| | | | |
|---|---|---|---|
| 1,456,525 | 5/1923 | West | 81/3.32 |
| 3,795,158 | 3/1974 | Morita | 81/3.32 |
| 3,950,801 | 4/1976 | Morrison | 81/3.2 |
| 4,171,650 | 10/1979 | Cardinal | 81/3.2 |
| 4,607,196 | 8/1986 | Abrahams et al. | 81/3.2 |

*Primary Examiner*—Roscoe V. Parker
*Attorney, Agent, or Firm*—E. Michael Combs

[57] ABSTRACT

A base housing, having a base housing top wall rotatably mounts a chuck assembly through the base housing top wall, with a support member mounted to the top wall having a track, with the track slidably positioning a mounting plate, with the mounting plate including a plurality of confronting first and second arcuate jaws to secure a jar lid, with the first and second arcuate jaws arranged in a position extending over the chuck, with the chuck including a plurality of arcuate chuck jaws in an annular array operative to engage a jar within the chuck jaws.

5 Claims, 4 Drawing Sheets

FIG. 5
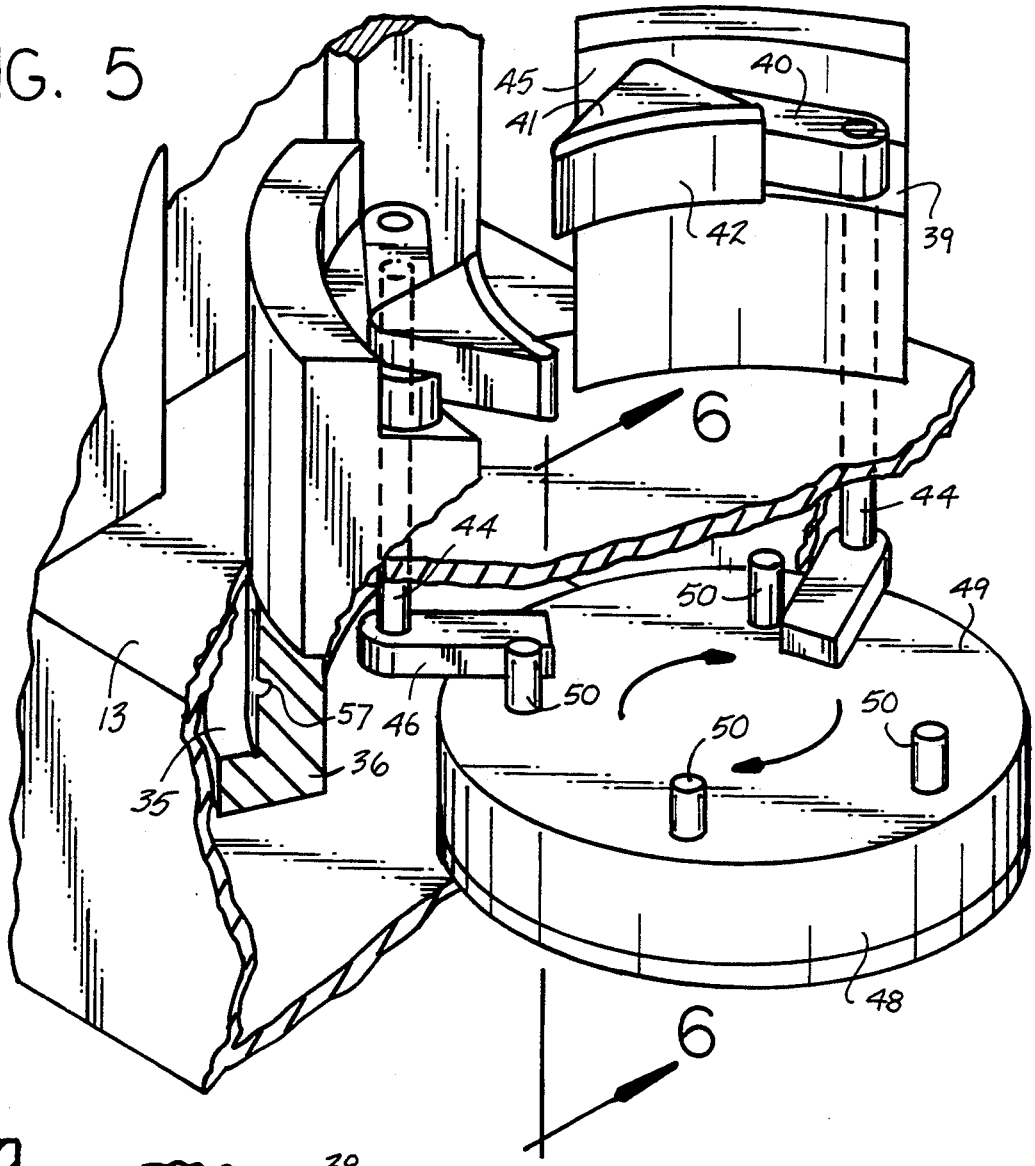
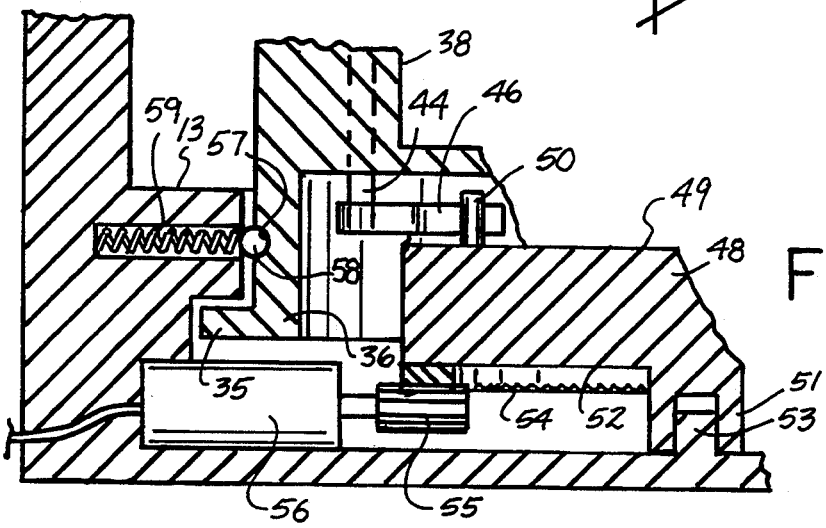
FIG. 6

JAR LID OPENER APPARATUS

BACKGROUND OF THE INVENTION

1. Field of the Invention

The field of invention relates to jaw lid opener apparatus, and more particularly pertains to a new and improved jar lid opener apparatus wherein the same is arranged to engage a jar lid and rotate an underlying jaw relative to the jar lid to disassemble the jar lid relative to the jar.

2. Description of the Prior Art

Jar lid opener structure is indicated in the prior art and exemplified by the U.S. Pat. Nos. 3,812,742; 3,592,352; and 4,766,781.

The instant invention attempts to overcome deficiencies of the prior art by providing for an organization to effect automatic opening of a jar lid permitting a torque drive assembly to effect engagement of jar engaging jaws and subsequent rotation of the jaws relative to the jar member to rotate the jar member relative to a jar lid and in this respect, the present invention substantially fulfills this need.

SUMMARY OF THE INVENTION

In view of the foregoing disadvantages inherent in the known types of jar lid opener apparatus now present in the prior art, the present invention provides a jar lid opener apparatus arranged to direct torque application to a jar body to effect rotation of the jar body relative to the jar lid. As such, general purpose of the present invention, which will be described subsequently in greater detail, is to provide a new and improved jar lid opener apparatus which has all the advantages of the prior art jar lid opener apparatus and none of the disadvantages.

To attain this, the present invention provides a base housing, having a base housing top wall rotatably mounting a chuck assembly through the base housing top wall, with a support member mounted to the top wall having a track, with the track slidably positioning a mounting plate, with the mounting plate including a plurality of confronting first and second arcuate jaws to secure a jar lid, with the first and second arcuate jaws arranged in a position extending over the chuck, with the chuck including a plurality of arcuate chuck jaws in an annular array operative to engage a jaw within the chuck jaws.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention provide a new and improved jar lid opening apparatus which has all the advantages of the prior art jar lid opener apparatus and none of the disadvantages.

It is another object of the present invention to provide a new and improved jar lid opener apparatus which may be easily and efficiently manufactured and marketed.

It is a further object of the present invention to provide a new and improved jar lid opener apparatus which is of a durable and reliable construction.

An even further object of the present invention is to provide a new and improved jar lid opener apparatus which is susceptible of a low cost of manufacture with regard to both materials and labor, and which accordingly is then susceptible of low prices of sale to the consuming public, thereby making such jaw lid opener apparatus economically available to the buying public.

Still yet another object of the present invention is to provide a new and improved jar lid opener apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the :following detailed description thereof. Such description makes reference to the annexed drawings wherein:

FIG. 5 is an isometric, partial sectional view of the chuck assembly and the underlying rotary actuator table.

FIG. 6 is an orthographic view, taken along the lines 6—6 of FIG. 5 in the direction indicated by the arrows.

DESCRIPTION OF THE PREFERRED EMBODIMENT

Figure 1:
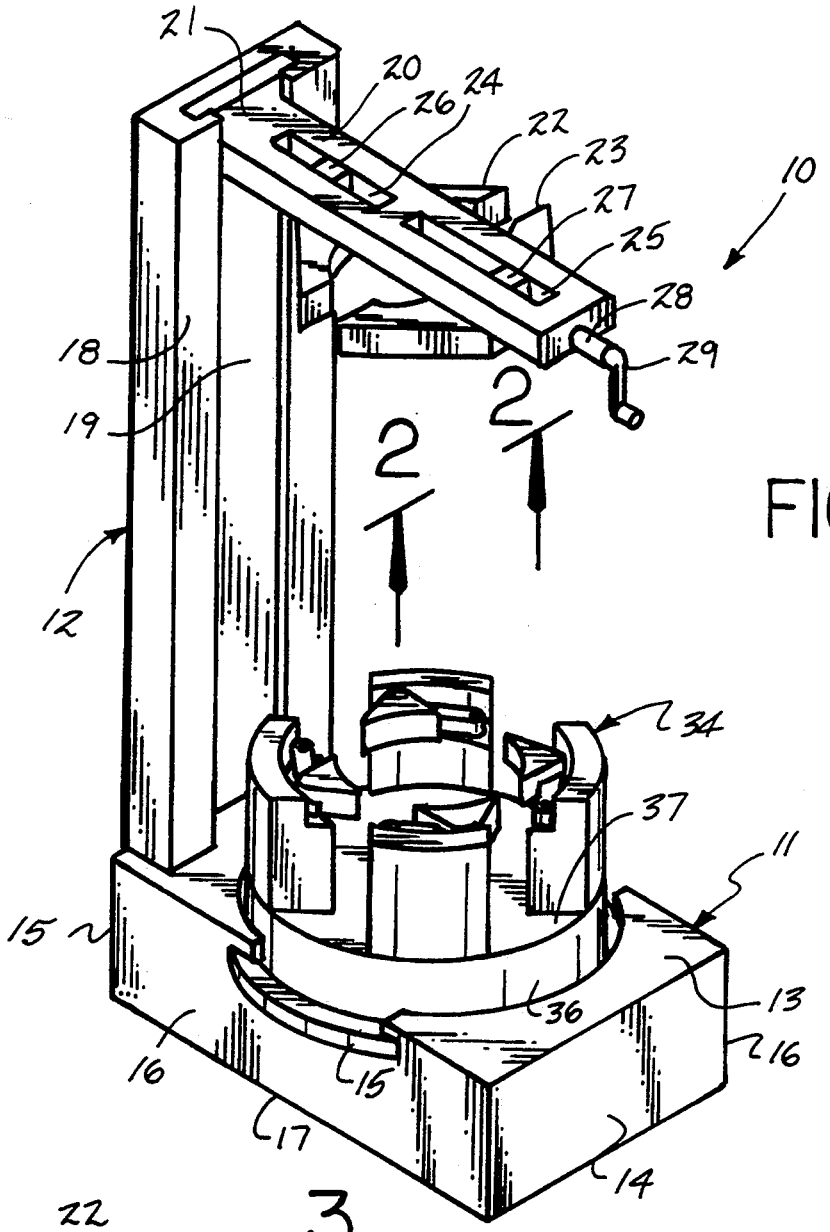
FIG. 1 is an isometric illustration of the invention.

With reference now to the drawings, and in particular to FIGS. 1 to 8 thereof, a new and improved jar lid opener apparatus embodying the principles and concepts of the present invention and generally designated by the reference numeral 10 will be described.

Figure 2:
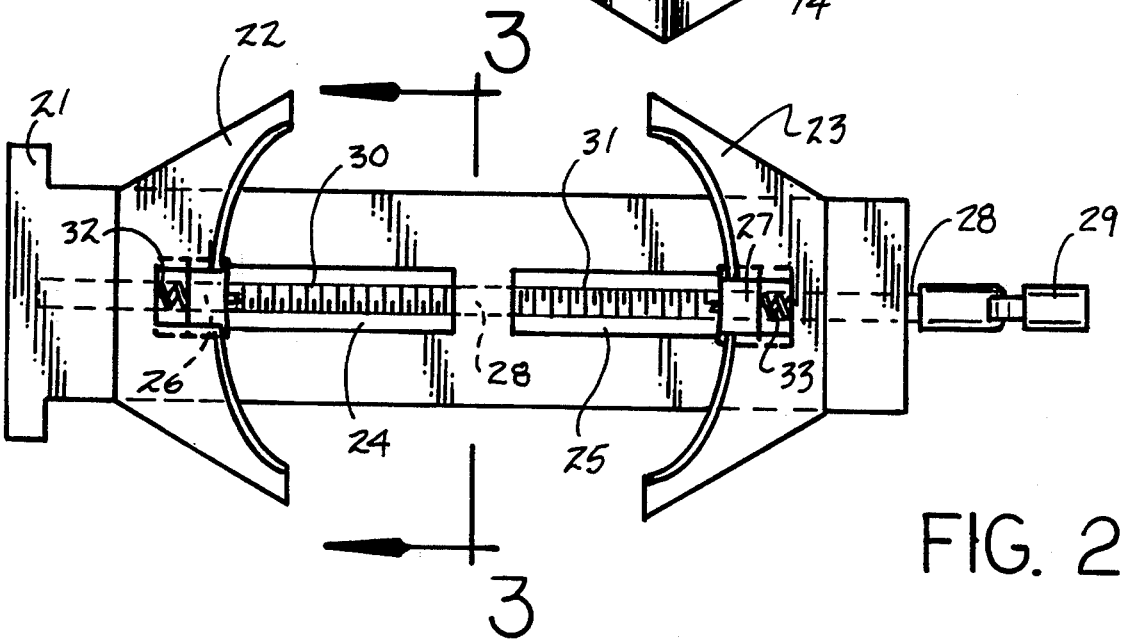
FIG. 2 is an orthographic view, taken along the lines 2—2 of FIG. 1 in the direction indicated by the arrows.
Figure 3:
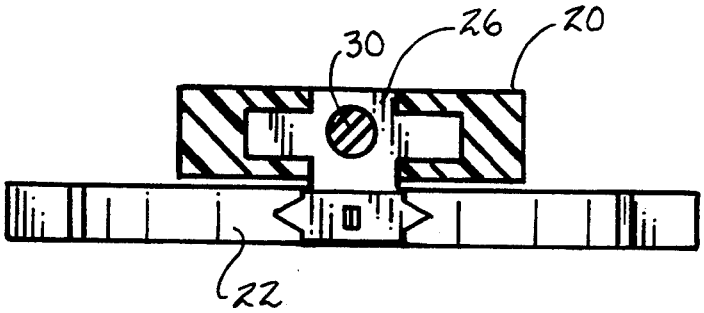
FIG. 3 is an orthographic view, taken along the lines 3—3 of FIG. 2 in the direction indicated by the arrows.
Figure 4:
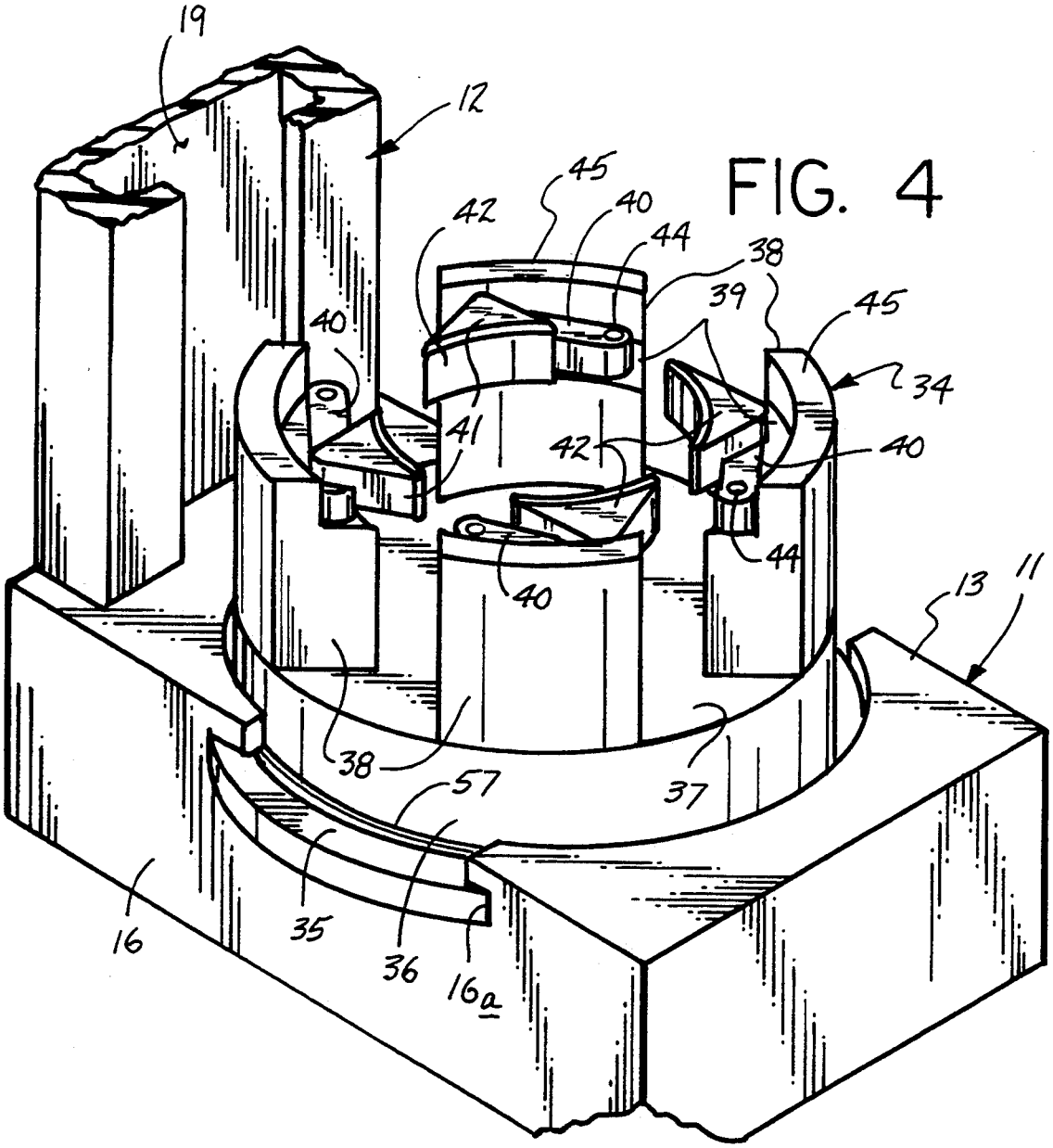
FIG. 4 is an isometric, partial view of the chuck assembly of the invention.

More specifically, the jaw lid opener apparatus 10 of the instant invention essentially comprises a base housing 11, including a support member 12 integrally mounted to the base housing. The base housing 11 includes a top wall 13 spaced from a bottom wall 17, spaced side walls 16 and a first end wall 14 spaced from a second end wall 15. Orthogonally mounted to the top wall 13 in adjacency to the second end wall 15 is the support member 12, having a support member front wall 18, including an elongate track 19 directed into the support member front wall 18, with the track orthogonally oriented relative to the base housing top wall 13. A mounting plate 20 having a mounting plate track follower 21 is orthogonally oriented relative to the track, with the mounting plate track follower 21 positioned within the track for sliding displacement along the track orienting the mounting plate 20 in a parallel relationship extending over the top wall 13 and an associated container chuck 34. The mounting plate includes first and second arcuate jaws 22 and 23 arranged in a facing mirror image relationship relative to one another oriented between the mounting plate 20 and the top wall 13, with the first and second respective arcuate jaws 22 and 23 slidably oriented within respective first and second slots 24 and 25 that are directed into the mounting plate 20, with the first and second slots 24 and 25 longitudinally aligned relative to one another and orthogonally oriented relative to the track 19, with the first arcuate jaw 22 having a first jaw guide lug 26 received within the first slot 24, and the second arcuate jaw 23 having a second jaw guide lug 27 received within the second slot 25, with a drive shaft 28 directed longitudinally and in adjacency to the first and second slots 24 and 25, with the drive shaft 28 orthogonally oriented relative to the track 19 such that the drive shaft 28 is threadedly directed through the first and second lugs 26 and 27, having a drive shaft handle 29 to effect rotation of the drive shaft such that the drive shaft includes a right hand threaded portion 30 threadedly directed through the first jaw guide lug 26 and a left hand threaded portion 31 directed threadedly through the second guide lug 27 to effect displacement of the first and second arcuate jaws 22 and 23 towards and away from one another to permit grasping of a jaw lid therebetween. A first spring 32 is interposed between the first end of the first slot 24 and the first guide lug 26, with a second spring 33 interposed between the second guide lug and a first end of the second slot, such as the first end of the first slot and the first end of the second slot arranged adjacent opposed ends of the mounting plate 20, as indicated in FIG. 2 for example. The first and second springs 32 and 33 provide tensioned engagement of the guide lugs 26 and 27 with the respective threaded portions 30 and 31 on the drive shaft 28. In this manner, the mounting plate 20 is slid longitudinally along the track 19 to vertically orient the first and second jaws 22 and 23 about a jar lid (not shown) and upon such orientation, the jaws are directed towards one another to engage fixedly the associated jar lid therebetween, with the body of the jaw mounted within the container chuck The container chuck 34 is rotatably mounted through the base housing top wall 13, having a rotatable annular disc positioned within the base housing 11 between the housing top and bottom walls 13 and 17 and projecting exteriorly of the side walls 16 through side wall slots **16*a*, such as illustrated in FIG. 4. The annular disc 35 is fixedly mounted to a chuck base 36 extending from the annular disc 35 projecting through the base housing top wall 13, such that the chuck base includes a chuck base top wall 37 mounting a plurality of support bosses mounted orthogonally and fixedly to the chuck base top wall 37 positioned in an annular array onto the chuck base top wall 37 positioned adjacent a periphery of the chuck base top wall 37 such that each support boss 38 includes a support boss mounting wall 39 spaced from and parallel relative to the chuck base top wall 37, with each mounting wall 39 having a crank arm 40 mounted thereon. Each crank arm 40 includes an arcuate jaw 41 pivotally mounted at a first end of each crank arm 40, with each crank arm arcuate jaw 41 having a resilient jaw face 42 of semi-cylindrical configuration to engage a jar body. The crank arm arcuate jaw 41 is mounted to the first end of the crank arm 40 about a jaw pivot axle 43 (see FIG. 8), with a second end of the crank arm 40 including a crank arm shaft 44 fixedly mounted to the crank arm 40 in an orthogonal relationship extending through the respective support boss 38 projecting into the chuck base 36. The lowermost distal end of each crank arm shaft 44 includes an actuator leg 46 fixedly mounted to the lowermost distal end of the crank: arm shaft 44, with the actuator leg 46 substantially orthogonally oriented relative to the crank arm 40. It should be further noted that each support boss 38 includes a support boss abutment wall 45 extending from each support boss 38 to provide for an abutment wall relative to each of the crank arms 40 and their associated arcuate jaws 41 to prevent excessive radial displacement of each crank arm arcuate jaw 41 relative to the chuck 34**.

Figure 7:
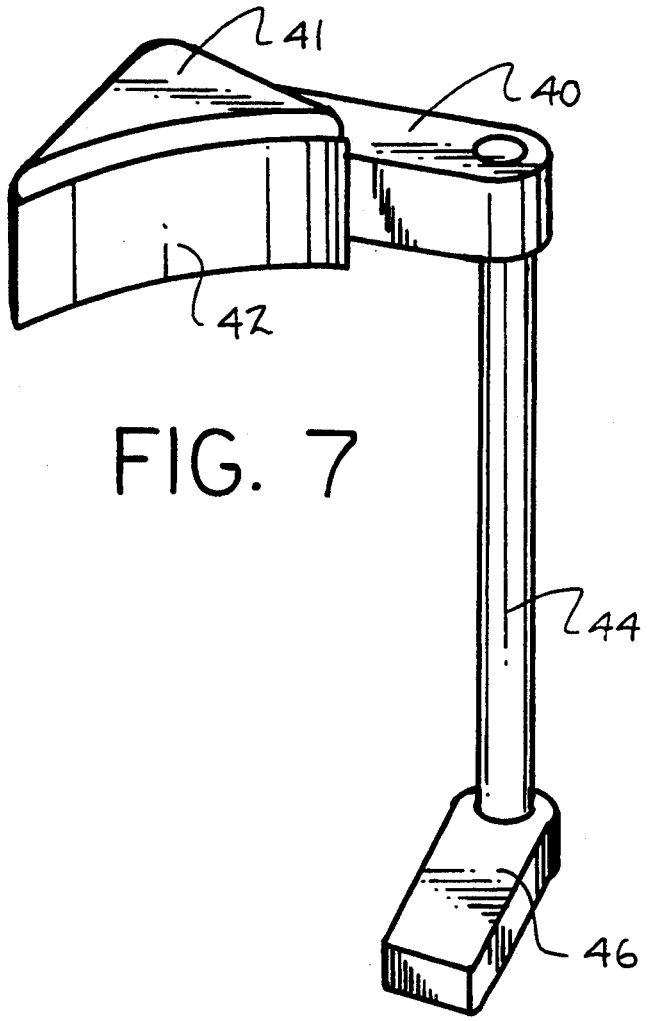
FIG. 7 is an isometric illustration of an individual jaw assembly as employed by the chuck assembly.
Figure 8:
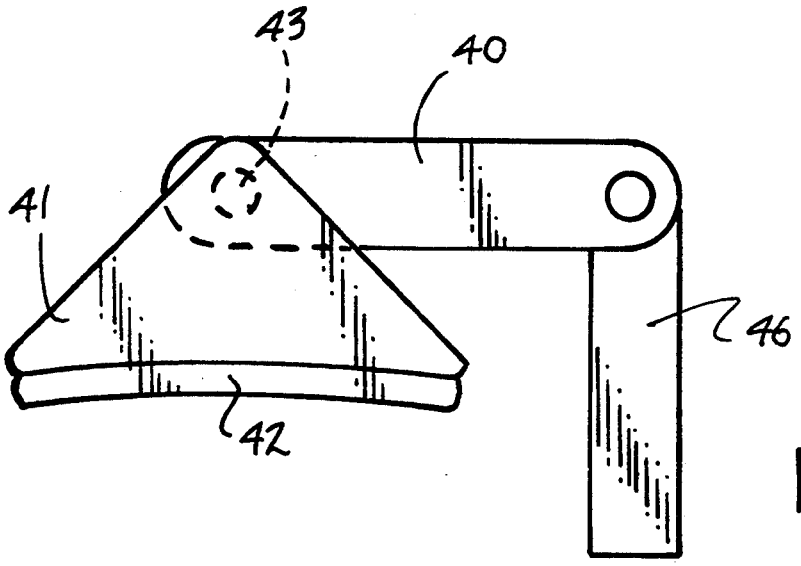
FIG. 8 is an orthographic top view of the jaw assembly, as indicated in FIG. 7.

Reference to FIGS. 6 and 7 indicates the use of a rotary actuator table 48 rotatably mounted in adjacency to the base housing bottom wall 17, such that the rotary actuator table 48 includes a table top wall 49 spaced from a table bottom wall 52 such that the table top wall 49 includes a plurality of abutment lugs 50 orthogonally mounted to the table top wall 40 in an annular array, wherein each abutment lug 50 is positioned in adjacency to one of the actuator legs 46 spaced from an associated crank arm shaft 44. The actuator table bottom wall includes an actuator table socket 51 arranged to rotatably receive a bottom wall pilot shaft 53 fixedly mounted to the base housing bottom wall to rotatably and coaxially mount the actuator table 48 between the chuck base 36 and the base housing bottom wall, as illustrated in the FIGS. 5 and 6. An annular gear rack 54 is mounted fixedly to the actuator table bottom wall 52 about the periphery of the bottom wall 52 in cooperative relationship with a rotary drive pinion 55 that in turn is mounted to a reversing motor 56 operative through conventional switching (not shown). An annular chuck base groove 37 directed into the chuck base 36 receives a friction sphere 58 driven by a sphere spring 59 to direct the sphere into the groove 57 to temporarily arrest rotation of the chuck base 36, whereupon rotation of the actuator table 48 directing the respective abutment lugs 50 to pivot the actuator legs 46 rotates the associated crank arm jaws 51 into engagement with an associated jar body, wherein continued rotation of the actuator table drives the chuck base in association with the actuator table whereupon subsequent to tightening of the jaws 41 relative to a jar body, the actuator table and the chuck base are in an interlocked relationship, whereupon continued drive of the drive motor continues to effect rotation of the jar body relative to an associated jar lid secured by the first and second jaws 22 and 23 to effect disassembly of an associated jar lid relative to a jar body.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of tile invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jar lid opener apparatus, comprising, a base housing, the base housing including a housing top wall spaced from a housing bottom wall, a housing first end wall spaced from a housing second end wall, and spaced housing side walls, with a support member fixedly mounted to the housing top wall in adjacency to the housing second end wall, with the support member having a front wall, the front wall including an elongate track, and the track orthogonally oriented relative to the housing top wall, and a mounting plate, the mounting plate including a track follower slidably received within the track, with the mounting plate arranged in a parallel spaced relationship relative to the housing top wall extending over the housing top wall, and the mounting plate including mounting plate jaw means for grasping a container lid therebetween, and a chuck assembly rotatably mounted through the base housing top wall for grasping a container body, and clamp means mounted to the chuck assembly for effecting clamping of a container body upon rotation of the chuck assembly relative to the mounting plate jaw means, and the mounting plate jaw means includes a first slot and a second slot directed into the mounting plate, with the first slot and the second slot arranged in a longitudinally aligned relationship orthogonally oriented relative to the track, and the mounting plate jaw means further including a first arcuate jaw having a first lug slidably received within the first slot, and a second arcuate jaw having a second lug slidably received within the second slot, wherein the first arcuate jaw and the second arcuate jaw are arranged in a facing mirror image relationship relative to one another oriented between the mounting plate and the housing top wall, and a drive shaft having a right hand threaded portion threadedly received through the first lug, and a left hand threaded portion threadedly received through the second lug, and wherein rotation of the drive shaft effects displacement of the first arcuate jaw relative to the second arcuate jaw, and the chuck assembly includes a chuck base, having an annular disc projecting radially and exteriorly of the chuck base projecting through at least one housing side wall of said spaced side walls, and the chuck base top wall includes an annular array of arcuate support bosses mounted fixedly and orthogonally thereon, wherein each of the arcuate support bosses includes a mounting wall arranged in a parallel spaced relationship relative to the chuck base top wall, and each mounting wall includes a crank arm, each crank arm having a crank arm first end, including a crank arm arcuate jaw pivotally mounted relative to the crank arm first end, and a rigid crank arm shaft orthogonally and fixedly mounted to the crank arm at a crank arm second end, with each crank arm shaft rotatably received within the chuck base.

2. An apparatus as set forth in claim 1 wherein the clamp means includes a rotary actuator table, the rotary actuator table includes a table top wall spaced from a table bottom wall, with the table top wall having an annular array of abutment lugs fixedly and orthogonally mounted to the table top wall adjacent the table top wall periphery, and each crank arm shaft includes an actuator leg fixedly and orthogonally mounted to each crank arm within the chuck base positioned in engagement with one of said abutment lugs where rotation of the actuator table effects displacement of each crank arm arcuate jaw radially of the chuck base top wall.

3. An apparatus as set forth in claim 2 wherein the clamp means further includes the actuator table having an annular gear rack mounted to the table bottom wall, and a rotary drive pinion in engagement with the annular gear rack, and a drive motor effecting rotation of the drive pinion, whereupon rotation of the drive motor effects rotation of the abutment lugs to effect rotation of each crank arm and crank arm arcuate jaw.

4. An apparatus as set forth in claim 3 wherein the base includes an annular groove, and a friction sphere is arranged for engagement with the annular groove within the base housing, the friction sphere includes a friction sphere spring to bias the friction sphere in engagement with the chuck base groove to position and arrest rotation of the chuck base relative to a container body.

5. An apparatus as set forth in claim 4 wherein the actuator table bottom wall includes a support socket, and the support housing bottom wail includes a pilot shaft received within the support socket, wherein the pilot shaft, the support socket, the actuator table, and the chuck base are coaxially aligned relative to one another.

* * * * *